US012454798B2

(12) United States Patent
Kovalick et al.

(10) Patent No.: US 12,454,798 B2
(45) Date of Patent: Oct. 28, 2025

(54) SNOW WING ASSEMBLY HAVING INDEPENDENT ROTATIONAL CONTROLS

(71) Applicant: Caterpillar Inc., Peoria, IL (US)

(72) Inventors: Benjamin J. Kovalick, Decatur, IL (US); Nathaniel Keith Harshman, Sullivan, IL (US); Bruce Raymond Vahling, Urbana, IL (US); David Cox, Monticello, IL (US)

(73) Assignee: Caterpillar Inc., Peoria, IL (US)

( * ) Notice: Subject to any disclaimer, the term of this patent is extended or adjusted under 35 U.S.C. 154(b) by 823 days.

(21) Appl. No.: 17/661,522

(22) Filed: Apr. 29, 2022

(65) Prior Publication Data

US 2023/0349118 A1 Nov. 2, 2023

(51) Int. Cl.
*E01H 5/07* (2006.01)
*E01H 5/06* (2006.01)

(52) U.S. Cl.
CPC ..... *E01H 5/076* (2013.01); *E01H 5/067* (2013.01); *E01H 5/061* (2013.01)

(58) Field of Classification Search
CPC .... E01H 5/00; E01H 5/04; E01H 5/06; E01H 5/061; E01H 5/067; E01H 5/076
USPC ..... 37/196, 219, 231, 266, 279
See application file for complete search history.

(56) References Cited

U.S. PATENT DOCUMENTS 8,596,376 B2 12/2013 Holverson et al.
10,053,826 B1 * 8/2018 Null ..... E01H 5/067
2015/0292171 A1 * 10/2015 May ..... E01H 5/067 37/279
2015/0308060 A1 * 10/2015 Beaird, III ..... E01H 5/065 37/231
2019/0136973 A1 * 5/2019 Rost ..... F16H 63/3433
2020/0354910 A1 11/2020 Niemela
2022/0064885 A1 * 3/2022 Niemela ..... E01H 5/066

FOREIGN PATENT DOCUMENTS

CN 110939094 B 10/2021
FR 2623830 B1 5/1990
FR 3084682 B1 12/2020
WO 2016013967 A1 1/2016

* cited by examiner

*Primary Examiner* — Christopher J Sebesta
*Assistant Examiner* — Evan A Bregel

(57) ABSTRACT

In some implementations, a lift assembly for a moldboard of a snow wing assembly of a machine may include a lifting mechanism, coupled to an undercarriage assembly of the machine, configured to lift the moldboard of the snow wing assembly to a bench height associated with the moldboard. The lift assembly may include a hinge rotatably mounted on a bar of the lifting mechanism, wherein the bar defines a first axis, and wherein the hinge is rotatably coupled to the moldboard about a second axis. The lift assembly may include a first rotational mechanism, coupled to the lifting mechanism and the hinge, configured to rotate the hinge and the moldboard about the first axis. The lift assembly may include a second rotational mechanism, coupled to the hinge and the moldboard, configured to rotate the moldboard about the second axis.

19 Claims, 7 Drawing Sheets

SNOW WING ASSEMBLY HAVING INDEPENDENT ROTATIONAL CONTROLS

TECHNICAL FIELD

The present disclosure relates generally to a snow wing assembly of a machine and, for example, to a snow wing assembly having independent rotational control mechanisms.

BACKGROUND

Machines, such as grader machines (e.g., motor graders), may use a snow wing (e.g., often including a moldboard or other snow blade) to displace, move, distribute, and/or grade snow and/or other material. The snow wing may need to be moved to various positions relative to a work surface and/or the grader machine to effectively carry out one or more of the functions described above and/or to enable other operations of the grader machine. For example, the snow wing may be mounted on a side of a cab of the grader machine and may need to be raised relative to the ground (e.g., to perform a benching operation), angled relative to an operator cab of the grader machine, and/or tilted (e.g., to change an angle between the moldboard and the ground), among other examples.

The grader machine may utilize a mast to enable the snow wing to be raised to a bench height. For example, the snow wing may be raised or lowered along the mast via one or more actuators. However, the mast may present an impediment to accessing an operator cab of the grader machine. Additionally, the mast may block or impede a view of an operator from inside of the operator cab. As another example, the grader machine may utilize a mast-less system to enable the snow wing to be raised to a bench height. However, the mast-less system may be limited as to an achievable bench height for the snow wing. Therefore, the mast-less system may be unable to perform certain operations that require a bench height greater than the achievable bench height associated with the mast-less system. Further, the grader machine may utilize a coupling between the snow wing (e.g., a moldboard of the snow wing) and a rear strut of the grader machine to change an angle (e.g., relative to the operator cab) and/or a tilt (e.g., relative to the ground) of the snow wing. For example, a coupling mechanism (e.g., a push pole) may enable a coupling between the rear strut of the grader machine and a moldboard of the snow wing. The coupling mechanism may include a shear pin to enable mechanical disengagement of the coupling with the rear strut of the grader machine (e.g., to provide relief to components when forces on the coupling become too large). However, such couplings require manual adjustment (e.g., such as when the shear pin breaks) and are mechanically complex.

In other words, to perform the various movement operations (e.g., lifting operations and/or rotational operations), the snow wing may be coupled to both a front end and a rear end of the grader machine. Such configurations may result in a dependency between the various movement operations. For example, changing a bench height of the moldboard may result in a tilt angle (e.g., relative to the ground) of the moldboard changing. As a result, a positional control of the moldboard may be complex and imprecise due to the dependency between the various movement operations.

The lift assembly for the snow wing of the present disclosure solves one or more of the problems set forth above and/or other problems in the art.

SUMMARY

In some implementations, a lift assembly for a moldboard of a snow wing assembly of a machine includes a lifting mechanism, coupled to an undercarriage assembly of the machine, configured to lift the moldboard of the snow wing assembly to a bench height associated with the moldboard; a hinge rotatably mounted on a bar of the lifting mechanism, wherein the bar defines a first axis, and wherein the hinge is rotatably coupled to the moldboard about a second axis; a first rotational mechanism, coupled to the lifting mechanism and the hinge, configured to rotate the hinge and the moldboard about the first axis; and a second rotational mechanism, coupled to the hinge and the moldboard, configured to rotate the moldboard about the second axis.

In some implementations, a motor grader includes a snow wing assembly including a moldboard rotatably coupled to a hinge about a first axis; and a lifting assembly for lifting the moldboard to a bench height, wherein the lifting assembly is coupled to an undercarriage assembly of the motor grader at a side of the motor grader, and wherein the lifting assembly includes the hinge rotatably coupled to a member of the lifting assembly about a second axis; a first rotational mechanism configured to rotate the moldboard about the first axis, wherein the first rotational mechanism includes a first hydraulic cylinder coupled to the hinge and the moldboard; and a second rotational mechanism configured to rotate the moldboard and the hinge about the second axis, wherein the second rotational mechanism includes a second hydraulic cylinder coupled to the lifting assembly and the hinge.

In some implementations, a snow wing assembly includes a moldboard having a first side and a second side; a lifting assembly rotatably coupled to the moldboard and configured to lift the moldboard to a bench height; and a roller bearing configured at an interface between the lifting assembly and the moldboard to enable the moldboard to rotate with respect to the lifting assembly about a first axis.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

This disclosure relates to a lift system or assembly for a snow wing, which is applicable to any machine that includes a mounted snow wing. For example, the machine may be a grader machine (e.g., a motor grader), a plow truck, a dump truck, a dozer, a backhoe loader, a tractor, an excavator, or another vehicle. In other words, although examples are described herein in connection with a motor grader, the lift assembly and/or snow wing assembly described herein may be similarly applied to any machine that includes a mounted snow wing.

Figure 1:
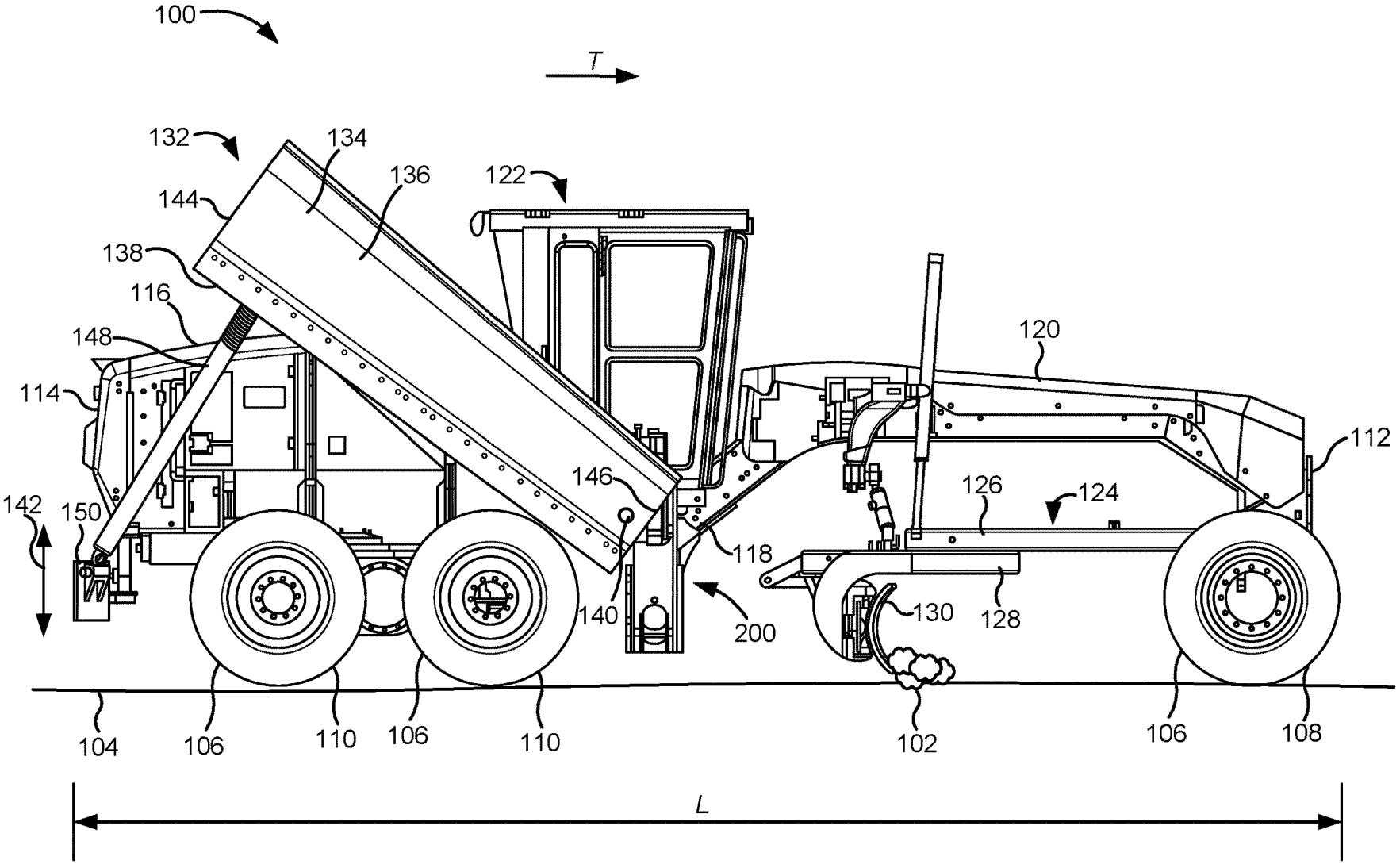
FIG. 1 is a side view of a motor grader described herein.

FIG. 1 is a side view of a motor grader 100 described herein. The motor grader 100 may also be referred to as a grader machine, among other examples. The motor grader 100 may be used to displace, spread, distribute, level, and grade, materials 102, such as snow or soil, over a work surface 104. Generally, a grading operation is performed during machine movement, and for this purpose, the motor grader 100 may include traction devices 106 that facilitate machine movement over the work surface 104. For example, traction devices 106 include a set of front wheels 108 disposed towards a front end 112 of the motor grader 100 and a set of rear wheels 110 disposed towards a rear end 114 of the motor grader 100. The terms "front" and "rear", as used herein, are in relation to an exemplary direction of travel of the motor grader 100, as represented by arrow, T, in FIG. 1, with the direction of travel being exemplarily defined from the rear end 114 towards the front end 112. The motor grader 100 defines a length, L, between the front end 112 and the rear end 114.

A movement of the traction devices 106 (e.g., a rotation of the set of front wheels 108 and the set of rear wheels 110) may be powered by a power source, such as an engine (not shown in FIG. 1), housed in a power compartment 116 of the motor grader 100. Further, the motor grader 100 may include an undercarriage assembly 118 and a sub-frame portion 120. The undercarriage assembly 118 may also be referred to herein as an undercarriage assembly of the motor grader 100. The sub-frame portion 120 may be movable relative to the undercarriage assembly 118. Further, the motor grader 100 may include an operator cab 122 supported on the sub-frame portion 120. The operator cab 122 may house various controls of the power source and other functions of the motor grader 100.

To grade and level the materials 102, the motor grader 100 may include a drawbar-circle-blade (DCB) arrangement or a drawbar-circle-moldboard (DCM) arrangement, which may also be referred to as a grader group 124. The grader group 124 may be supported by the sub-frame portion 120, and may include a drawbar 126, a circle member 128, and a blade 130 (referred to as a moldboard), each of which may function in concert to perform a grading operation on the work surface 104.

As shown in FIG. 1, the motor grader 100 may also include a snow wing assembly 132 mounted on the motor grader 100. For example, the snow wing assembly 132 may be mounted to the undercarriage assembly 118. The snow wing assembly 132 may be mounted on a side of the motor grader 100 (e.g., on a side of the operator cab 122). For example, as shown in FIG. 1, the snow wing assembly 132 may be mounted on the right hand side of the operator cab 122 relative to the direction of travel T. In other examples, the snow wing assembly 132 may be mounted on the left hand side of the operator cab 122 relative to the direction of travel T. The snow wing assembly 132 may include a moldboard 134. The moldboard 134 may also be referred to as a blade, a plow, and/or a snowplow, among other examples. The moldboard 134 may include a surface 136, such as a curved surface or a concave surface, that may help receive and agglomerate the materials 102 over the work surface 104. As an example, the moldboard 134 may define an edge 138 at a bottom end (e.g., closer to the work surface 104) of the surface 136 to help engage and scrape the materials 102 off the work surface 104 and distribute, level, and grade the work surface 104, during a grading operation.

The snow wing assembly 132 may be mounted to the motor grader 100 via a lift assembly 200 (e.g., also referred to herein as a lifting assembly). The lift assembly 200 may be coupled to the motor grader 100 (e.g., via the undercarriage assembly 118). The lift assembly 200 may be configured to link the snow wing assembly 132 to an undercarriage assembly (e.g., the undercarriage assembly 118) of the motor grader 100. The lift assembly 200 may include one or more lifting mechanisms, such as one or more actuators (e.g., hydraulic actuators and/or pneumatic actuators) and/or other components configured to raise and/or lower the snow wing assembly along a direction 142. A vertical clearance of the snow wing assembly 132 in the direction 142 may be referred to as a bench height. Additionally, as described in more detail elsewhere herein, the lift assembly 200 may be configured to angle and/or tilt the moldboard 134.

The snow wing assembly 132 may enable the motor grader 100 to perform a benching application, which may involve grading and/or distributing materials 102 from an elevated surface (e.g., elevated relative to the work surface 104). For example, the moldboard 134 may be used to remove, grade, or distribute snow from a top portion of a bank. The moldboard 134 may include an outboard end 144 and an inboard end 146. "Outboard" and "inboard" may be relative to the motor grader 100 and/or the operator cab 122. For example, the moldboard 134 may have an approximately rectangular configuration having two long edges (e.g., the edge 138 and the corresponding edge approximately parallel to the edge 138) and two short edges (e.g., at the outboard end 144 and the inboard end 146). As shown in FIG. 1, the snow wing assembly 132 may be coupled to the lift assembly 200 proximate to the inboard end 146 of the moldboard 134. In other words, the moldboard 134 may be coupled to the lift assembly 200 proximate to one of the short edges (e.g., at the outboard end 144 and the inboard end 146) of the moldboard 134.

The snow wing assembly 132 may be coupled to the lift assembly 200 via a coupling assembly 140. The coupling assembly 140 may enable the snow wing assembly 132 to rotate in multiple rotational directions. For example, the coupling assembly 140 may enable the snow wing assembly 132 (e.g., and the moldboard 134) to rotate in a first rotational direction 164 (e.g., shown in FIG. 4). For example, the snow wing assembly 132 may include an actuator 148, such as a hydraulic actuator or a pneumatic actuator, among other examples. The actuator 148 may be coupled to the undercarriage assembly 118 (e.g., proximate to the rear end 114 of the motor grader 100) and to the moldboard 134 (e.g., proximate to the outboard end 144 of the moldboard 134). The coupling assembly 140 may also enable the snow wing assembly 132 (e.g., and the moldboard 134) to rotate in a second rotational direction 166 (e.g., shown in FIG. 5). The first rotational direction 164 may enable the outboard end 144 of the moldboard 134 to move closer to and/or further from the motor grader 100 (e.g., from the operator cab 122 of the motor grader 100). For example, the inboard end 146 of the moldboard 134 may be fixed at the coupling assembly 140 and the outboard end 144 of the moldboard 134 may be free to rotate in the first rotational direction 164 and the second rotational direction 166.

As shown in FIG. 1, a tilting operation (e.g., in the second rotational direction 166) may be controlled via the actuator 148 that is coupled to the moldboard 134 and a rear strut 150 of the motor grader 100. As a result, a lifting operation (e.g., via the lift assembly 200) may necessarily alter an angle of the moldboard 134 (e.g., in the second rotational direction 166) as controlled by the actuator 148 that is coupled to the rear strut 150. In other words, FIG. 1 depicts an example snow wing assembly 132 in which rotational controls (e.g., in the first rotational direction 164, the second rotational direction 166, and a lifting operation along the bench height 156) are not independent. As depicted and described in more detail elsewhere herein, the lift assembly 200 may be associated with a configuration that enables independent control of the various rotational and lifting operations associated with the snow wing assembly 132 and/or the moldboard 134 (e.g., by eliminating a coupling of the moldboard 134 with the rear strut 150, among other features).

As used herein, "actuator" or "cylinder" may refer to a hydraulic cylinder, a hydraulic actuator, a pneumatic cylinder, a pneumatic actuator, rod-style cylinders, and/or welded body cylinders, among other examples. For example, the lift assembly 200 may utilize a fluid system, such as a hydraulic system, to power one or more components of the lift assembly 200. The fluid system may include one or more actuators or cylinders. For example, the lift assembly 200 may include one or more hydraulic cylinders. The hydraulic cylinder(s) may be single acting cylinders, double acting cylinders, tie-rod cylinders, welded rod cylinders, and/or telescopic cylinders, among other examples. The hydraulic cylinder(s) may be internal valve cylinders (e.g., where a control valve is included internally in the cylinder) or external valve cylinder (e.g., where the control value is external to the cylinder). In examples where the lift assembly 200 includes multiple cylinders or actuators, the multiple cylinders or actuators may be included in a single circuit or fluid line, may be included in in separate circuits or fluid lines, may be plumbed in series with one another, and/or may be plumbed in parallel with one another.

Figure 4:
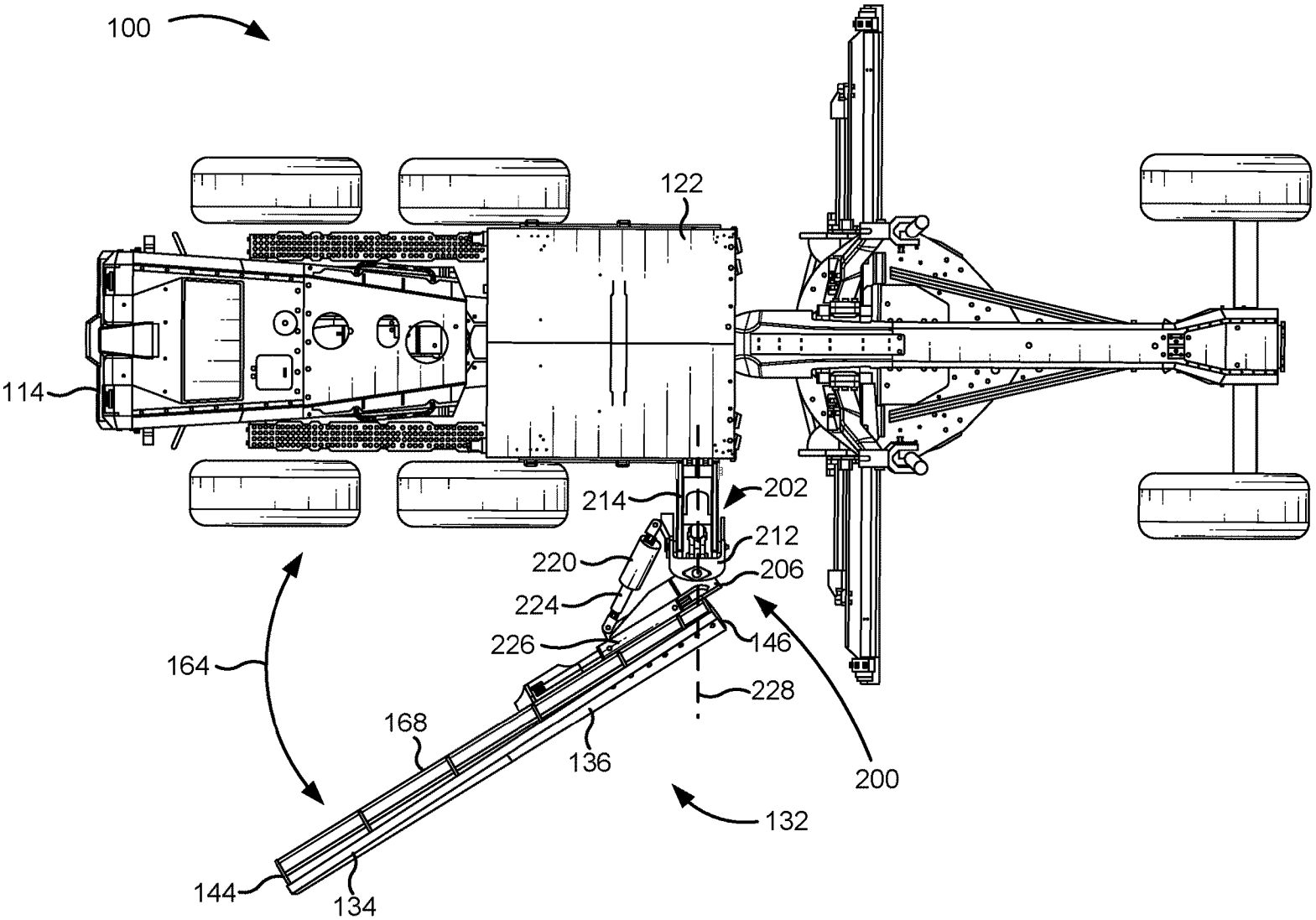
FIG. 4 is a top view of the motor grader having a snow wing assembly described herein.
Figure 5:
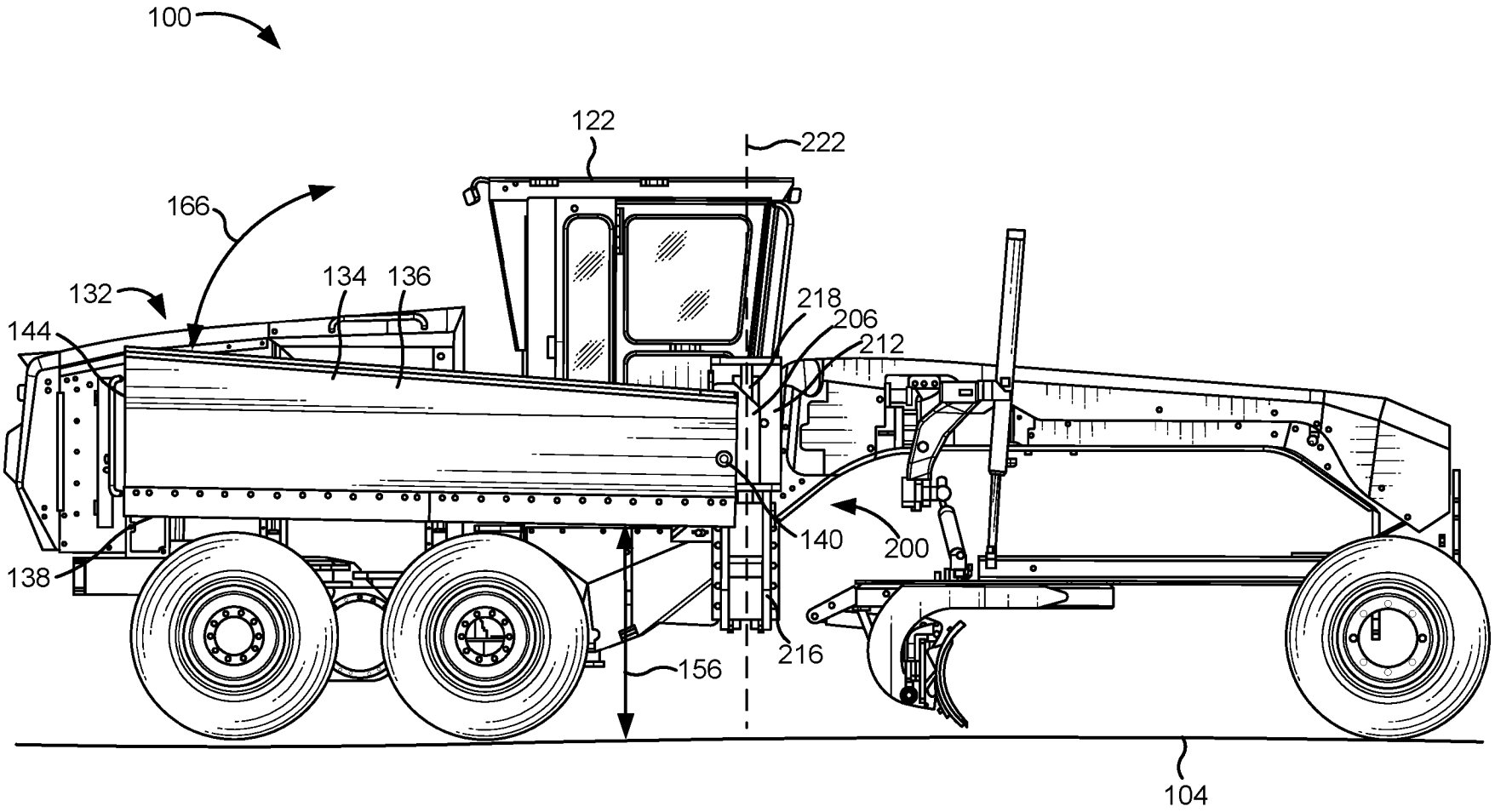
FIG. 5 is a side view of the motor grader having the snow wing assembly described herein.

The coupling assembly 140 may enable the moldboard 134 to rotate in the first rotation direction 164 via a hinge 206 (e.g., not depicted in FIG. 1) that is rotatably coupled to the lift assembly 200. The first rotational direction 164 may enable the snow wing assembly 132 to be placed into an operational state (e.g., with the outboard end 144 of the moldboard 134 extended away from the operator cab 122, as shown in FIG. 4) or a stored state (e.g., with the outboard end 144 of the moldboard 134 rotated proximate to the operator cab 122, as shown in FIG. 5). For example, the stored state may enable the motor grader 100 to operate without the snow wing assembly 132 protruding from the side of the motor grader 100.

As indicated above, FIG. 1 is provided as an example. Other examples may differ from what is described with regard to FIG. 1.

Figure 2:
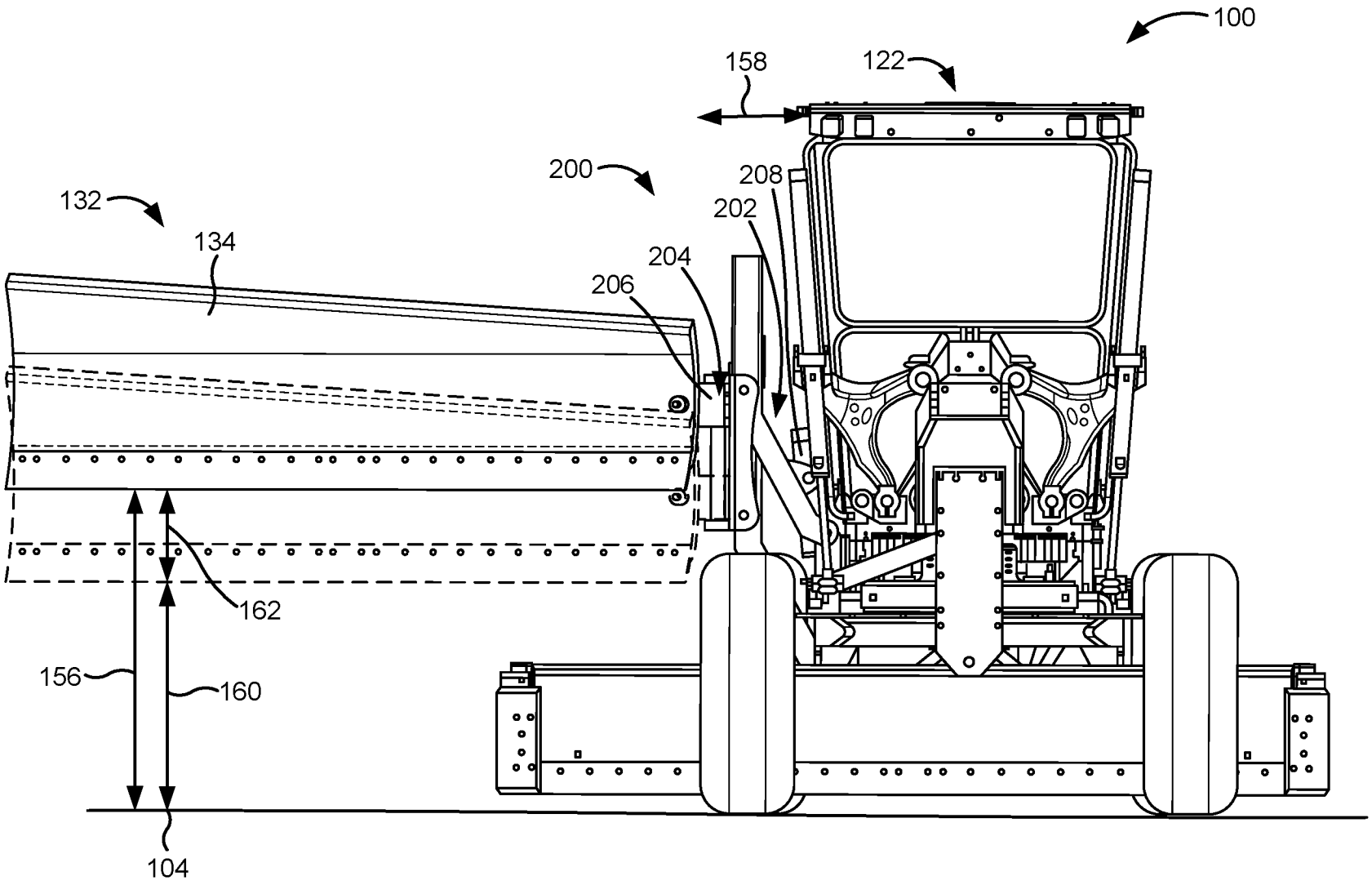
FIG. 2 is a front view of the motor grader and a lift assembly described herein.

FIG. 2 is a front view of the motor grader 100 and the lift assembly 200 described herein. In some implementations, the lift assembly 200 may include a first lifting mechanism 202 and a second lifting mechanism 204. In other implementations, the lift assembly 200 may include a single lifting mechanism. The first lifting mechanism 202 may be mechanically coupled to an undercarriage assembly (e.g., the undercarriage assembly 118) of the motor grader 100. The second lifting mechanism may be mechanically coupled to the first lifting mechanism 202 and the moldboard 134. In some implementations, the lift assembly 200 may include a single lifting mechanism (e.g., that is configured to raise the moldboard 134 to a bench height (e.g., the bench height 156).

The first lifting mechanism 202 may be configured to lift (e.g., raise and/or lower) the moldboard 134 of the snow wing assembly 132 a first portion 160 of the bench height 156 associated with the moldboard 134. The second lifting mechanism 204 may be configured to lift (e.g., raise and/or lower) the moldboard 134 of the snow wing assembly 132 a second portion 162 of the bench height 156 associated with the moldboard 134. The bench height 156 may be an achievable distance that the lift assembly 200 is capable of raising the snow wing assembly 132 (e.g., the moldboard 134) from a work surface (e.g., the work surface 104) associated with the motor grader 100. For example, the bench height 156 may be measured from the ground to the edge 138 of the moldboard 134. The bench height 156 may be a maximum height that the lift assembly 200 is capable of lifting the snow wing assembly 132 (e.g., the moldboard 134) from the ground. In some examples, the bench height 156 may be greater than 40 inches. More specifically, the bench height 156 may be greater than 50 inches. In some examples, the bench height 156 may be approximately 60 inches.

In some examples, the first portion 160 may be approximately 75% of the bench height 156 and the second portion 162 may be approximately 25% of the bench height 156. In other examples, the first portion 160 and the second portion 162 may be different percentages of the bench height 156. In other words, the first lifting mechanism 202 may be configured to lift (e.g., raise and/or lower) the moldboard 134 of the snow wing assembly 132 to the first portion 160 of the bench height 156 and the second lifting mechanism 204 may be configured to lift (e.g., raise and/or lower) the moldboard 134 of the snow wing assembly 132 the remainder (e.g., the second portion 162) of the bench height 156. In this way, the lift assembly 200 may be a dual stage lift assembly (e.g., with a first stage being associated with the first lifting mechanism 202 and a second stage being associated with the second lifting mechanism 204).

When the snow wing assembly 132 is raised to the bench height 156, the snow wing assembly 132 (e.g., the moldboard 134) may be a distance 158 from the operator cab 122. For example, as the lift assembly 200 raises the snow wing assembly 132, the lift assembly 200 may cause the snow wing assembly 132 to be pulled closer to the operator cab 122. In other words, when the lift assembly 200 lowers the snow wing assembly 132 to the ground (e.g., to the work surface 104), the lift assembly 200 may cause the snow wing assembly 132 (e.g., the inboard end 146 of the moldboard 134) to be pushed further away from the operator cab 122 than when the snow wing assembly 132 is raised to the bench height 156. The distance 158 may be measured between the inboard end 146 of the moldboard 134 and a side (e.g., a door) of the operator cab 122 on which the snow wing assembly 132 is mounted. The lift assembly 200 may be configured to ensure that the distance 158 is less than or equal to a threshold, such as 6 feet or similar distances.

The first lifting mechanism 202 may include a four-bar linkage configured to lift the moldboard 134 via a hydraulic cylinder associated with the four-bar linkage. The four-bar linkage may include a first vertical member 210, a second vertical member 212, a first horizontal member 214, and a second horizontal member 216 (e.g., shown in FIG. 3). "Vertical" and "horizontal" are provided for ease of description and are not intended to describe an orientation of the members of the four-bar linkage (e.g., the orientation of the members of the four-bar linkage may change as the four-bar linkage moves). The first vertical member 210 may be coupled to the undercarriage assembler of the motor grader 100. The hydraulic cylinder 208 may be coupled to the first vertical member 210 and the first horizontal member 214 such that when the hydraulic cylinder 208 extends a rod of the hydraulic cylinder 208, the four-bar linkage causes the second vertical member 212 to be raised (e.g., because the first vertical member 210 is fixed in position). As another example, the hydraulic cylinder 208 may be coupled to the second vertical member 212 and the second horizontal member 216 such that when the hydraulic cylinder 208 extends a rod of the hydraulic cylinder 208, the four-bar linkage causes the second vertical member 212 to be raised relative to the first vertical member 210.

The lift assembly 200 may be configured to raise and/or lower the snow wing assembly 132 and/or the moldboard 134 as described in more detail herein. For example, the first lifting mechanism 202 and/or the second lifting mechanism 204 may enable the lift assembly 200 to raise the moldboard 134 to a bench height (e.g., the bench height 156) that is greater than or equal to a first threshold distance (e.g., 40 inches, 48 inches, 50 inches, 60 inches, or another distance) and to ensure that a distance (e.g., the distance 158) between the moldboard 134 (e.g., the inboard end 146) and the operator cab 122 of the motor grader is less than a second threshold distance (e.g., 72 inches or similar distances). In other words, the dual stage system of the lift assembly 200 may enable the lift assembly 200 to raise the moldboard 134 to a bench height (e.g., the bench height 156) that is greater than or equal to a first threshold distance while also ensuring that the distance (e.g., the distance 158) between the moldboard 134 (e.g., the inboard end 146) and the operator cab 122 is not too large so as to cause collisions with nearby objects when the moldboard 134 is raised to the bench height 156 and/or when the snow wing assembly 132 is in the stored state. Eliminating the coupling between the moldboard 134 and the rear strut 150 may enable the moldboard 134 to be stored in the stored state closer to the operator cab 122.

As indicated above, FIG. 2 is provided as an example. Other examples may differ from what is described with regard to FIG. 2.

Figure 3:
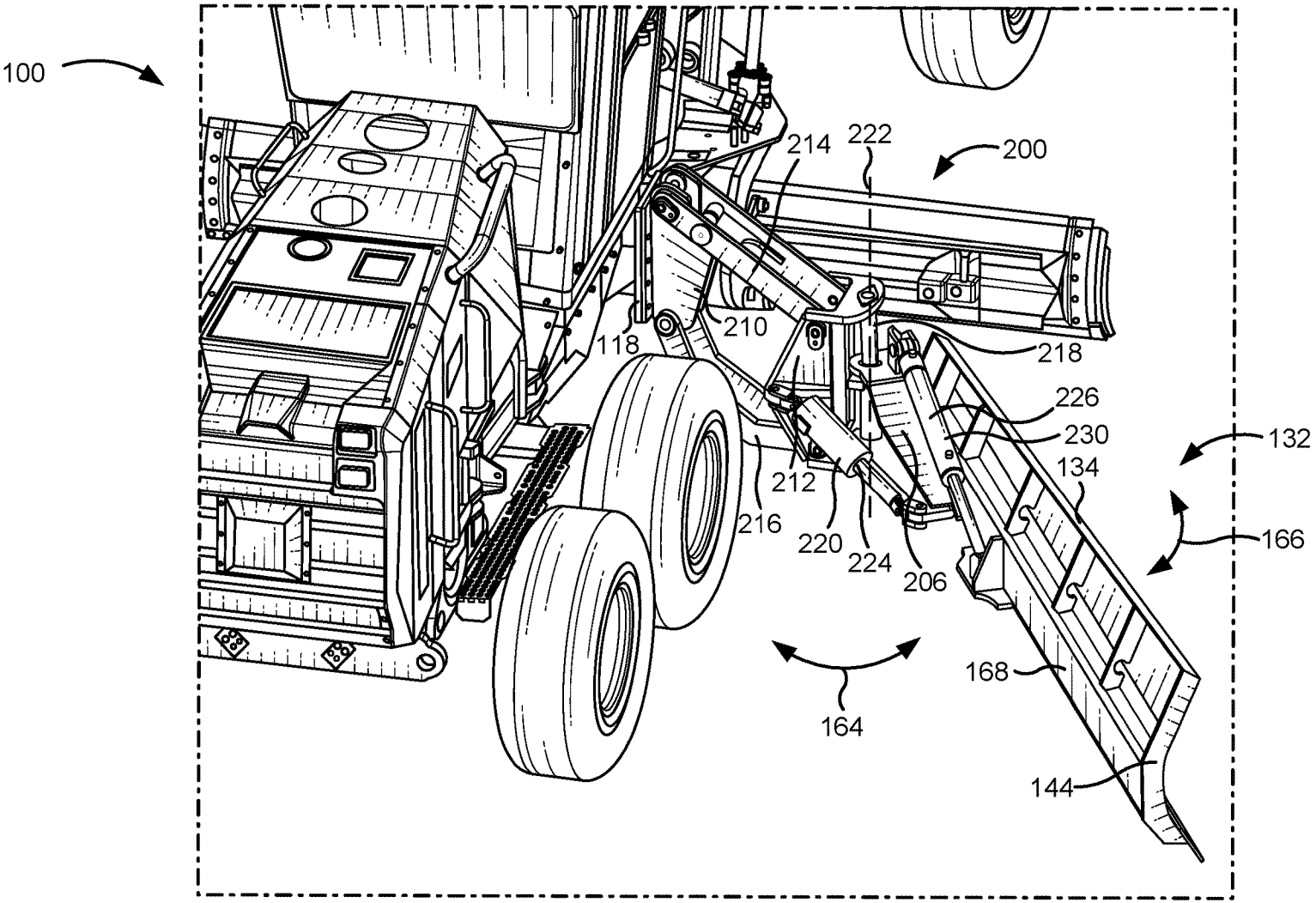
FIG. 3 is a perspective view of the lift assembly described herein.

FIG. 3 is a perspective view of the lift assembly 200 described herein. As described above, the lift assembly 200 may include a lifting mechanism (e.g., the first lifting mechanism 202 and/or the second lifting mechanism 204), coupled to the undercarriage assembly 118 of the motor grader 100, configured to lift the moldboard 134 of the snow wing assembly 132 to the bench height 156 associated with the moldboard 134.

As described above, the lifting mechanism may include a four-bar linkage having the first vertical member 210 coupled to the undercarriage assembly 118, the second vertical member 212, the first horizontal member 214, and the second horizontal member 216. The second lifting mechanism 204 may be disposed at, or near, the second vertical member 212 of the four-bar linkage (e.g., of the first lifting mechanism 202). For example, as shown in FIG. 3, the second lifting mechanism 204 may include the hinge 206 slidably coupled to the bar 218. The hinge 206 may be coupled to the moldboard 134. The second lifting mechanism 204 may be configured to cause the hinge 206 to slide along the bar 218. The second lifting mechanism 204 may include an actuator, a hydraulic cylinder, one or more chains, one or more gear systems, a motor, and/or a cable and pulley system, among other examples.

The hinge 206 may be slidably and rotatably coupled to the bar 218. For example, the hinge 206 may include a sleeve that is disposed around the bar 218. The hinge 206 may be configured to slide up and down along the bar 218 (e.g., to raise and/or lower the moldboard 134 the second portion 162 of the bench height 156 or the entire bench height 156) and the rotate around the bar 218 (e.g., to rotate the moldboard 134 in the first rotational direction 164 described above and as depicted in FIG. 4). A rod of a hydraulic cylinder of the lifting mechanism may be coupled to the hinge 206. For example, in some cases, the hydraulic cylinder may be configured to retract the rod to cause the hinge 206 to slide up the bar 218 (e.g., to cause the moldboard 134 to raise the second portion 162 of the bench height 156 or the entire bench height 156). Similarly, the hydraulic cylinder may be configured to extend the rod to cause the hinge 206 to slide down the bar 218 (e.g., to cause the moldboard 134 to lower the second portion 162 of the bench height 156 or the entire bench height 156).

The lift assembly 200 may include a first rotational mechanism 220. The first rotational mechanism 220 may be referred to herein as an angle mechanism or an angling mechanism. For example, the first rotational mechanism 220 may be configured to rotate the hinge 206 and the moldboard 134 in the first rotational direction 164. For example, the bar 218 may define an axis 222. The first rotational direction 164 may be about (e.g., around) the axis 222 (e.g., the first rotational direction 164 may be defined by the axis 222). In other words, the first rotational mechanism 220 may be configured to rotate the hinge 206 and the moldboard 134 about (e.g., around) the axis 222. The first rotational mechanism 220 may be coupled to the lifting mechanism and the hinge 206. As shown in FIG. 3, the first rotational mechanism 220 may not be coupled directly to the moldboard 134 (e.g., and may cause the moldboard 134 to rotate via the coupling to the hinge 206 and because the moldboard 134 is coupled to the hinge 206).

For example, the first rotational mechanism 220 may include a hydraulic cylinder 224. The hydraulic cylinder 224 may be mechanically coupled to the hinge 206 and the lifting mechanism. For example, the hydraulic cylinder 224 may be mechanically coupled to the hinge 206 and the second vertical member 212 of the four-bar linkage. For example, a first end of the hydraulic cylinder 224 (e.g., the rod end of the hydraulic cylinder 224 as shown in FIG. 3 as an example) may be mechanically coupled to the hinge 206. A second end of the hydraulic cylinder 224 (e.g., a head end of the hydraulic cylinder 224, as shown in FIG. 3 as an example) may be mechanically coupled to the lifting mechanism (e.g., to the second vertical member 212 of the four-bar linkage). For example, the ends of the hydraulic cylinder 224 may be respectively coupled to the hinge 206 and the second vertical member 212 via pin joints or another mechanical coupling that allows for rotation in at least one rotational direction.

The first rotational mechanism 220 may be configured to cause the moldboard 134 to rotate in the first rotational direction 164 via the hydraulic cylinder 224. For example, in the example configuration depicted in FIG. 3, the first rotational mechanism 220 may be configured to extend the rod of the hydraulic cylinder 224 to cause the outboard end 144 of the moldboard 134 to rotate away from the operator cab 122 in the first rotational direction 164. Similarly, the first rotational mechanism 220 may be configured to retract the rod of the hydraulic cylinder 224 to cause the outboard end 144 of the moldboard 134 to rotate toward the operator cab 122 in the first rotational direction 164. For example, extending and/or retracting the rod of the hydraulic cylinder 224 may cause the hinge 206 to rotate about (e.g., around) the bar 218. Because the hinge 206 is coupled to the moldboard 134, as the hinge 206 rotates about the bar 218, the moldboard 134 will rotate in the first rotational direction 164.

Figure 6:
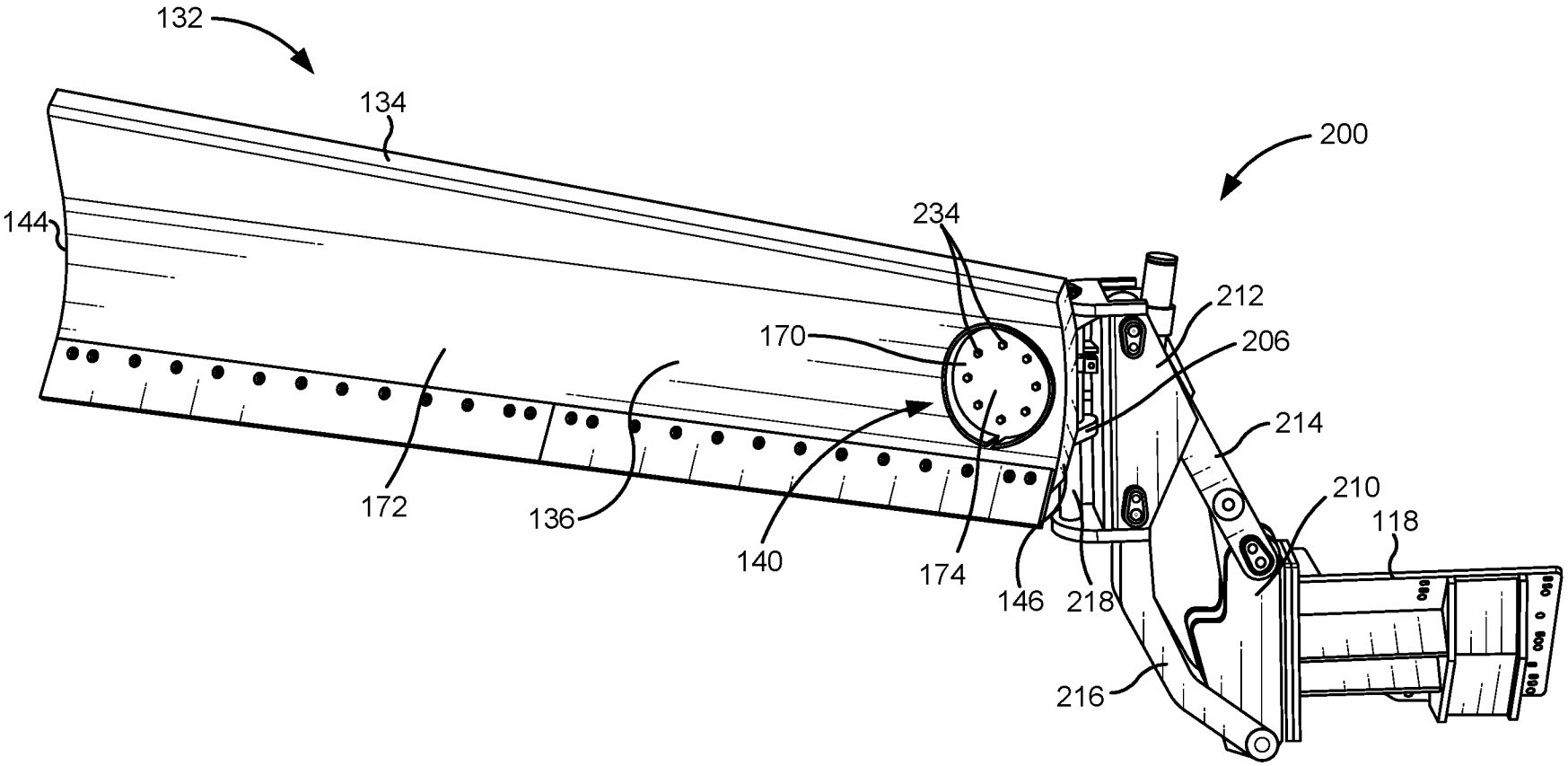
FIG. 6 is a perspective view of the snow wing assembly and the lift assembly described herein.
Figure 7:
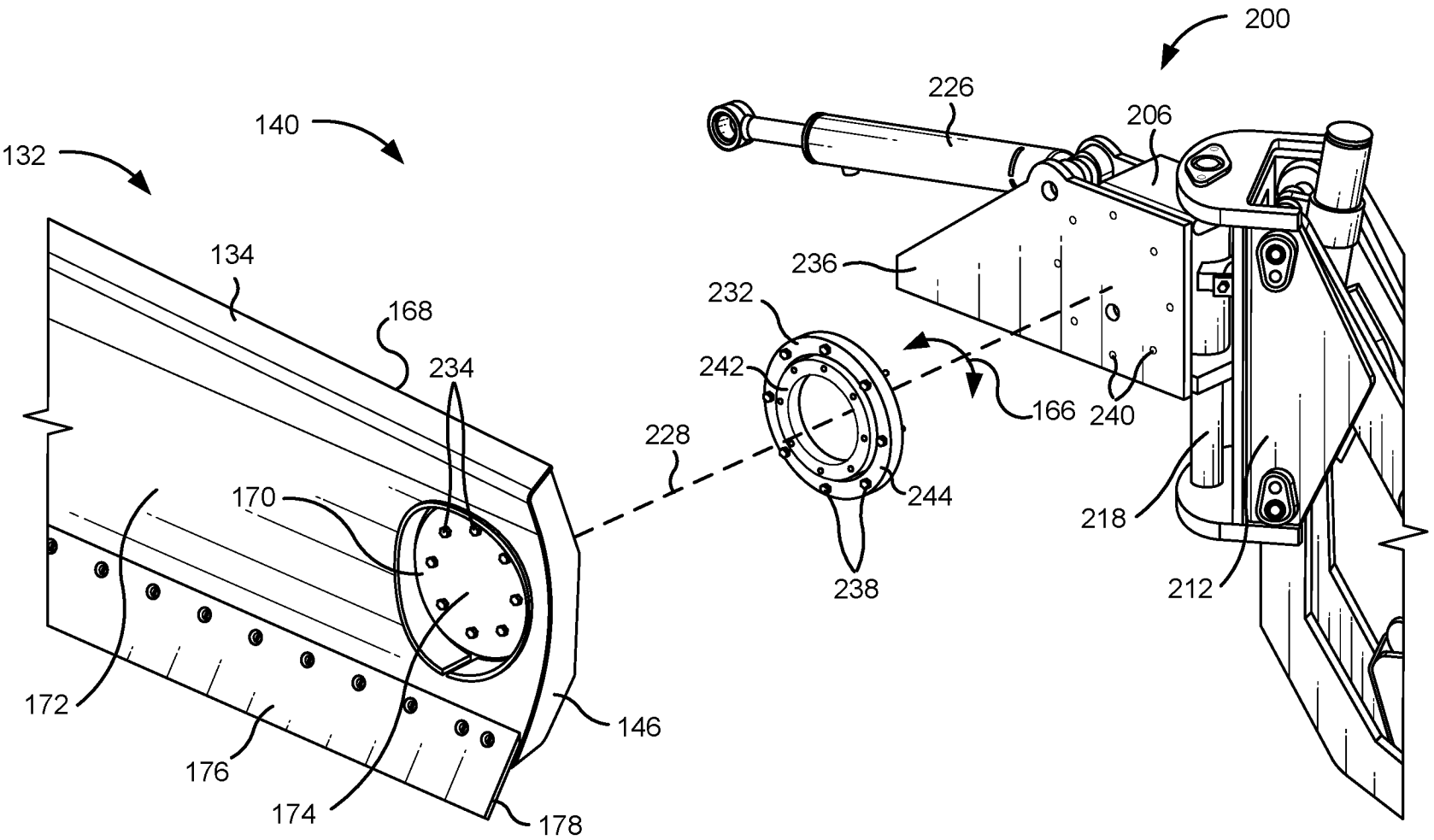
FIG. 7 is an exploded view of a coupling assembly described herein.

The lift assembly 200 may include a second rotational mechanism 226. The second rotational mechanism 226 may be referred to herein as a tilt mechanism or a tilting mechanism. For example, the second rotational mechanism 226 may be configured to rotate the moldboard 134 in the second rotational direction 166. For example, the hinge 206 may be rotatably coupled to the moldboard 134 about an axis 228 (e.g., defined by the coupling assembly 140). The axis 228 is depicted in FIGS. 4, 6, and 7. The second rotational mechanism 226 may be configured to rotate the moldboard 134 about the axis 228. The axis 222 may be perpendicular to the axis 228. The second rotational mechanism 226 may be coupled to the hinge 206 and the moldboard 134. For example, unlike the first rotational mechanism 220, the second rotational mechanism 226 may not be directly coupled to the lifting mechanism and/or the motor grader 100. As described elsewhere herein, this may enable independent movement of the moldboard 134 in the first rotational direction 164, the second rotational direction 166, and along the bench height 156.

For example, the second rotational mechanism 226 may include a hydraulic cylinder 230. The hydraulic cylinder 230 may be mechanically coupled to the hinge 206 and the moldboard 134. For example, the hydraulic cylinder 230 may be mechanically coupled to the hinge 206 and the rear side 168 of the moldboard 134. The rear side 168 may be opposite to the surface 136 (e.g., may be on an opposite side of the moldboard 134 from the surface 136). A first end of the hydraulic cylinder 230 (e.g., the rod end of the hydraulic cylinder 230, as shown in FIG. 3 as an example) may be mechanically coupled to the moldboard 134 (e.g., to the rear side 168). A second end of the hydraulic cylinder 230 (e.g., a head end of the hydraulic cylinder 230, as shown in FIG. 3 as an example) may be mechanically coupled to the hinge 206. For example, the ends of the hydraulic cylinder 230 may be respectively coupled to the hinge 206 and the moldboard 134 via pin joints or another mechanical coupling that allows for rotation in at least one rotational direction.

The second rotational mechanism 226 may be configured to cause the moldboard 134 to rotate in the second rotational direction 166 via the hydraulic cylinder 230. For example, in the example configuration depicted in FIG. 3, the second rotational mechanism 226 may be configured to extend the rod of the hydraulic cylinder 230 to cause the outboard end 144 of the moldboard 134 to rotate toward the ground (e.g., toward the work surface 104) in the second rotational direction 166. Similarly, the second rotational mechanism 226 may be configured to retract the rod of the hydraulic cylinder 230 to cause the outboard end 144 of the moldboard 134 to rotate away from the ground (e.g., away from the work surface 104) in the second rotational direction 166. For example, extending and/or retracting the rod of the hydraulic cylinder 230 may cause an angle between the edge 138 of the moldboard 134 and the group (e.g., the work surface 104) to change (e.g., to decrease when the rod is extended and to increase when the rod is retracted, or vice versa if the configuration of the hydraulic cylinder 230 is flipped, such that the rod end is coupled to the hinge 206).

For example, as the rod of the hydraulic cylinder 230 is extended or retracted, the moldboard 134 may rotate about a coupling (e.g., of the coupling assembly 140) with the hinge 206 and the hinge 206 may remain fixed with respect to the second rotational direction 166. Because the second rotational mechanism 226 is coupled to the hinge 206 (e.g., which is fixed relative to the second rotational direction 166, but is rotatable relative to the first rotational direction 164), a movement of the moldboard 134 in the first rotational direction 164 may be independent of a movement of the moldboard 134 in the second rotation direction 166. For example, because the first rotational mechanism 220 is coupled to the hinge 206, rather than the moldboard 134, a rotation of the moldboard 134 in the second rotation direction 166 will not impact or change a rotational position of the moldboard 134 relative to the first rotational direction 164. Additionally, because the second rotational mechanism 226 is coupled to the hinge 206, rather than the lifting mechanism or the undercarriage assembly 118 (e.g., to a strut, such as the rear strut 150), a rotation of the moldboard 134 in the first rotation direction 164 will not impact or change a rotational position of the moldboard 134 relative to the second rotational direction 166.

Additionally, the connection point between the first rotational mechanism 220 and the lifting mechanism may not be to a fixed component (e.g., a mechanically fixed or immovable component). For example, the second vertical member 212 may be a moveable component (e.g., the second vertical member 212 may move with respect to the bench height 156 as the lift assembly 200 raises and lowers the moldboard 134). Similarly, because the hinge 206 is coupled to the second vertical member 212 (e.g., via the bar 218), the connection point between the second rotational mechanism and the hinge 206 is also not fixed with respect to the bench height 156 and may move with respect to the bench height 156 as the lift assembly 200 raises and lowers the moldboard 134. Therefore, as the moldboard 134 moves along the bench height 156, the connections of the first rotational mechanism 220 and the second rotational mechanism 226 may also move relative the bench height 156, thereby enabling a rotational position of the moldboard with respect to the first rotational direction 164 and the second rotational direction 166 to be maintained as the moldboard 134 is raised and/or lowered along the bench height 156. Therefore, the movement and/or rotation of the moldboard 134 may be independent in at least three directions (e.g., along the bench height 156, in first rotational direction 164, and in second rotational direction 166). In other words, a lifting operation of the moldboard 134 via the lifting assembly 200, an angling operation of the moldboard 134 via the first rotational mechanism 220, and a tilting operation of the moldboard 134 via the second rotational mechanism 226 are configured to move the moldboard independently respective to one another based on the hydraulic cylinder 230 being coupled to the hinge 206 and the moldboard 134 and based on the hydraulic cylinder 224 being coupled to the lifting assembly 200 (e.g., the second vertical member 212) and the hinge 206. As used herein, "independent" or "independently" may refer to a movement or rotation of the moldboard 134 in a first direction not impacting a position of the moldboard 134 with respect to a second direction.

As indicated above, FIG. 3 is provided as an example. Other examples may differ from what is described with regard to FIG. 3.

FIG. 4 is a top view of the motor grader 100 having the snow wing assembly 132 described herein. As shown in FIG. 4, the first rotational mechanism 220 may be configured to rotate the moldboard 134 in the first rotational direction 164. As shown in FIG. 4, the outboard end 144 of the moldboard 134 may be free (e.g., may include no attachments or couplings to components associated with causing a movement and/or rotation of the moldboard 134). For example, the hinge 206 and the second rotational mechanism 226 may be coupled to the moldboard 134 proximate to the inboard end 146 of the moldboard 134.

For example, the moldboard 134 may have a length M. In some implementations, the second rotational mechanism 226 (e.g., the hydraulic cylinder 230) may be coupled to the moldboard 134 at a distance from the inboard end 146 that is less than or equal to M/2 (e.g., may be coupled to the moldboard 134 closer to the inboard end 146 than the outboard end 144). Additionally, or alternatively, the second rotational mechanism 226 (e.g., the hydraulic cylinder 230) may be coupled to the moldboard 134, but not to a rear strut or other component of the undercarriage assembly 118 of the motor grader 100. For example, in some cases, the second rotational mechanism 226 (e.g., the hydraulic cylinder 230) may be coupled to the moldboard 134 at a distance from the inboard end 146 that is greater than M/2, but because the second rotational mechanism 226 (e.g., the hydraulic cylinder 230) is coupled to the hinge 206, rather than to the undercarriage assembly 118 of the motor grader 100, the outboard end 144 of the moldboard 134 may be free. This enables the snow wing assembly 132 to not be associated with any connections or couplings to a rear end 114 of the motor grader 100.

The hydraulic cylinder 224 may be associated with a pressure relief valve that is configured to relieve a pressure associated with the hydraulic cylinder 224 based on the pressure associated with the hydraulic cylinder 224 satisfying a pressure threshold. For example, in operation, the moldboard 134 (e.g., at the surface 136) may contact material (e.g., dirt, snow, earth, and/or other material). In some cases, the moldboard 134 (e.g., at the surface 136) may contact material or an object that results in a force applied to the first rotational mechanism 220 and/or the lift assembly 200 increasing (e.g., due to the moldboard 134 being in a fixed position relative to the first rotational direction 164) to a level that may damage or break components of the first rotational mechanism 220 and/or the lift assembly 200. To prevent this, the pressure relief valve may relieve a pressure associated with the hydraulic cylinder 224 (e.g., enabling the moldboard 134 to move relative to the first rotational direction 164 without an operator command or change in a hydraulic circuit associated with the hydraulic cylinder 224) to prevent forces applied to the first rotational mechanism 220 and/or the lift assembly 200 from increasing to a level that may damage or break components. In other words, the hydraulic cylinder 224 may be enabled to provide hydraulic relief to the moldboard 134. The position of the moldboard 134 relative to the first rotational direction 164 may be returned to the position prior to the pressure relief valve relieving pressure associated with the hydraulic cylinder 224 via an operator command (e.g., automatically from an input component, such as a control board, inside the operator cab 122 and without requiring the operator to exit the operator cab 122). For example, the hydraulic cylinder 224 (and/or the hydraulic cylinder 230) may be configured to return the moldboard 134 to an operator indicated position via a hydraulic operation.

As shown in FIG. 4, the first lifting mechanism 202 may be configured to be approximately perpendicular to the operator cab 122. For example, the first horizontal member 214 and/or the second horizontal member 216 may be approximately perpendicular to a side of the operator cab 122. In some other implementations, the first lifting mechanism 202 (e.g., the first horizontal member 214 and/or the second horizontal member 216) may not be perpendicular to the side of the operator cab 122. For example, the first lifting mechanism 202 (e.g., the first horizontal member 214 and/or the second horizontal member 216) may be angled, relative to the side of the operator cab 122, toward the rear end 114 of the motor grader 100. In some implementations, the angle between the first lifting mechanism 202 (e.g., the first horizontal member 214 and/or the second horizontal member 216) and the side of the operator cab 122 may be greater than or equal to 50 degrees and less than 90 degrees, among other examples. Rotating the first lifting mechanism 202 toward the rear end 114 of the motor grader 100 may improve operator visibility from the operator cab 122 and/or may reduce a distance that the snow wing assembly 132 extends away from the operator cab 122 in a stored state (e.g., may improve a packing of the snow wing assembly 132).

As indicated above, FIG. 4 is provided as an example. Other examples may differ from what is described with regard to FIG. 4.

FIG. 5 is a side view of the motor grader 100 having the snow wing assembly 132 described herein. FIG. 5 depicts the snow wing assembly 132 in a stored state (e.g., with the outboard end 144 rotated in the first rotation direction 164 proximate to the operator cab 122). As depicted in FIG. 4, because the outboard end 144 of the moldboard 134 is free, the moldboard 134 may be stored in the stored state with the outboard end 144 closer to the operator cab 122 than if the moldboard 134 included connections or attachments proximate to the outboard end 144 (e.g., as depicted in FIG. 1).

The second rotational mechanism 226 may be configured to move or rotate the moldboard 134 in the second rotational direction 166 (e.g., about the axis 228 defined by the coupling assembly 140). For example, in the position depicted in FIG. 5, the moldboard 134 (e.g., the edge 138 of the moldboard 134) may be approximately parallel to the work surface 104. However, if the hydraulic cylinder 230 is actuated, the angle between the moldboard 134 (e.g., the edge 138 of the moldboard 134) and the work surface 104 may change. This may enable the moldboard 134 to be operated in additional positions, such was when performing a benching operation, thereby providing additional flexibility to the operator of the motor grader 100.

In some cases, the coupling assembly 140 may include a pin extending through the moldboard 134 and the hinge 206. In such examples, the pin may define the axis 228. For example, the pin may enable the moldboard 134 to rotate in the second rotational direction 166 (e.g., around the pin) relative to the hinge 206. In other examples, the coupling assembly 140 may include a roller bearing 232. For example, the roller bearing 232 may be disposed at an interface between the moldboard 134 and the hinge 206. The roller bearing 232 may enable the moldboard 134 to rotate with respect to the hinge 206 about the axis 228 (e.g., in the second rotational direction 166), as depicted and described in more detail in connection with FIGS. 6 and 7.

As indicated above, FIG. 5 is provided as an example. Other examples may differ from what is described with regard to FIG. 5.

FIG. 6 is a perspective view of the snow wing assembly 132 and the lift assembly 200 described herein. In some cases, to enable the moldboard 134 to be moved to various positions, the moldboard 134 may be rotatably mounted to the hinge 206. To facilitate the coupling of the moldboard 134 to the hinge 206, the coupling assembly 140 may be used. The coupling assembly 140 may include a pin that is passed through the moldboard 134 and the hinge 206 to rotatably couple the moldboard 134 with the hinge 206 (e.g., via a nut, such as a castle nut).

However, in some cases, over time, the coupling assembly 140 and/or pin may become susceptible to seizure within the components (e.g., the moldboard 134 and/or the hinge 206) via which they contact (e.g., due to the harshness of conditions in which the grader machine operates). Additionally, a size of the pin or bolt required to support forces exerted on the coupling assembly 140 may result in a torque required to fasten the pin or bolt being extremely high (e.g., 3100 newton-meters (Nm)).

Therefore, in some cases, the coupling assembly 140 may include the roller bearing 232. The roller bearing 232 may be used with the lift assembly 200, the first rotational mechanism 220, and/or the second rotational mechanism 226. Additionally, the roller bearing 232 may be used with other configurations associated with a snow wing assembly and/or a lift assembly. For example, the roller bearing 232 may be used with a single four-bar linkage lift assembly, a masted lift assembly, and/or other lift assemblies configured to lift the moldboard 134 to a bench height. For example, the roller bearing 232 may be configured at an interface between the lift assembly 200 and the moldboard 134 to enable the moldboard 134 to rotate with respect to the lift assembly 200 about the axis 228.

The moldboard 134 may include a recess 170. The recess 170 may extend into a front side 172 of the moldboard 134. The front side 172 may include the surface 136. For example, the front side 172 may be an opposite side of the moldboard 134 from a side that includes the interface between the moldboard 134 and the lift assembly 200 (e.g., with the hinge 206). For example, the front side 172 may be an opposite side of the moldboard 134 from rear side 168. The recess 170 may extend a depth into the front side 172. As shown in FIG. 5, the recess 170 may have a circular shape. In some implementations, the recess 170 may have a shape corresponding to a shape of the roller bearing 232. The recess 170 may provide a flat surface for the roller bearing 232 to mate to. For example, as described above, the moldboard 134 may be associated with a curved surface or a concave surface, that may help receive and agglomerate the materials 102 over the work surface 104. However, the curved surface may not provide sufficient contact area for the roller bearing 232 to be coupled to the moldboard 134. The recess 170 may provide a surface 174 that is approximately flat (e.g., not curved) to enable the roller bearing 232 to be coupled to the moldboard 134 proximate to the surface 174.

The moldboard 134 may be coupled to the roller bearing 232 via a plurality of fasteners 234. As shown in FIG. 6, the moldboard 134 may be coupled to the roller bearing 232 via eight fasteners 234. The moldboard 134 may include a plurality of holes or apertures corresponding to locations of the fasteners 234 (e.g., to enable the fasteners 234 to pass through the moldboard 134). The fasteners 234 may be bolts, pins, screws, studs, rivets, or another type of fastener. For example, the fasteners 234 may be bolts having a size (e.g., a diameter) that is less than a threshold. For example, the threshold may be a size (e.g., a diameter) corresponding to a metric coarse (M) 20 (M20) bolt, such as 20 millimeters. In other words, the fasteners 234 may be bolts having a size of M20 or smaller. This may enable a torque required to fasten the fasteners 234 to be reduced when compared to using a single, larger bolt for the coupling assembly 140. Additionally, a shear strength of the coupling assembly 140 may be increased because forces are distributed across the plurality of fasteners 234, rather than over a single bolt or pin.

As indicated above, FIG. 6 is provided as an example. Other examples may differ from what is described with regard to FIG. 6.

FIG. 7 is an exploded view of the coupling assembly 140 described herein. As shown in FIG. 7, the roller bearing 232 may be disposed at an interface between the lift assembly 200 (e.g., between the hinge 206) and the moldboard 134. For example, the hinge 206 may include a surface 236. The surface 236 may be a flat surface to enable the roller bearing 232 to be coupled to hinge 206 at the surface 236. The surface 236 and the side 168 of the moldboard 134 may define the interface between the lift assembly 200 (e.g., between the hinge 206) and the moldboard 134.

The hinge 206 may be coupled to the roller bearing 232 via a plurality of fasteners 238. As shown in FIG. 6, the moldboard 134 may be coupled to the roller bearing 232 via eight fasteners 238. The hinge 206 may include a plurality of apertures 240 corresponding to locations of the fasteners 238 (e.g., to enable the fasteners 238 to pass through the hinge 206). The fasteners 238 may be bolts, pins, screws, studs, rivets, or another type of fastener. For example, the fasteners 238 may be the same as, or similar to, the fasteners 234.

The roller bearing 232 may include a slew bearing, a cylindrical roller bearing, a cross roller bearing, a needle bearing, a tapered roller bearing, or another type of roller bearing. For example, the roller bearing 232 may include a first ring 242 and a second ring 244. The first ring 242 and the second ring 244 may be configured to rotate relative to one another above the axis 228 (e.g., in the second rotational direction 166). For example, the roller bearing 232 may include one or more rolling elements, such as balls, rollers, and/or other rolling elements between the first ring 242 and the second ring 244 to enable the first ring 242 and the second ring 244 to rotate relative to one another. The roller bearing 232 and/or the one or more rolling elements may be internally greased and/or lubricated to enable a smooth and fluid rotation of the first ring 242 and the second ring 244 relative to one another.

The moldboard 134 may be coupled to the first ring 242 via the plurality of fasteners 234 passing from the surface 174 of the moldboard 134 through the roller bearing 232 (e.g., through the first ring 242). Similarly, the lift assembly 200 (e.g., the hinge 206) is coupled to the second ring 244 via the plurality of fasteners 238 (e.g., passing through the roller bearing 232 and the apertures 240). As a result, the moldboard 134 may be coupled to the hinge 206 (e.g., via the roller bearing 232) and may be enabled to rotate relative to the hinge 206 about the axis 228 in the second rotational direction 166. For example, the second rotational mechanism 226 may cause the hydraulic cylinder 230 to be actuated to rotate the moldboard 134 relative to the hinge 206 about the axis 228 in the second rotational direction 166, as described in more detail elsewhere herein.

In some implementations, the coupling assembly 140 may be configured such that the axis 228 is approximately above a leading end 178 of a cutting edge 176 of the moldboard 134. For example, the moldboard 134 may include the cutting edge 176, which may be a metal or other hard material configured to cut into material on the work surface 104 (e.g., to facilitate removal of the material). The leading end 178 may sometimes be referred to as a "toe" of the moldboard 134 and/or the cutting edge 176. In some cases, an offset between the axis 228 and the leading end 178 may cause the leading end 178 to cut into the work surface 104 when the moldboard 134 is rotated about the axis 228 (e.g., and is lowered relative to the bench height 156). The cutting into the work surface 104 by the leading end 178 may sometimes be referred to as toe gouge. By configuring the axis 228 to be approximately above the leading end 178 of the cutting edge 176 of the moldboard 134 (e.g., such that there is no, or little, offset between the axis 228 and the leading end 178 relative to the length of the moldboard 134), the leading end 178 may not cut into the work surface 104 when the moldboard 134 is rotated about the axis 228 (e.g., and is lowered relative to the bench height 156). For example, in some cases, the leading end 178 of the cutting edge 176 may be offset a distance from the inboard end 146 (e.g., the leading end 178 may be configured to be some distance away from the inboard end 146 toward the outboard end 144). In some implementations, a distance (e.g., along a length of the moldboard 134 from the outboard end 144 to the inboard end 146) between the axis 228 and the leading end 178 may be less than a threshold (e.g., where the threshold may be 2 millimeters, 5 millimeters, 10 millimeters, or another distance).

As indicated above, FIG. 7 is provided as an example. Other examples may differ from what is described with regard to FIG. 7.

INDUSTRIAL APPLICABILITY

In some cases, the moldboard 134 depicted in FIG. 1 may be raised or lowered along the mast via one or more actuators. However, the mast may present an impediment to accessing an operator cab 122 of the motor grader 100. Additionally, the mast may block or impede a view of an operator from inside of the operator cab 122. As another example, the motor grader 100 may utilize a mast-less system to enable the moldboard 134 to be raised to a bench height. However, the mast-less system may be limited as to an achievable bench height for the moldboard 134. Therefore, the mast-less system may be unable to perform certain operations that require a bench height greater than the achievable bench height associated with the mast-less system. Further, the motor grader 100 may utilize a coupling between the moldboard 134 and a rear strut 150 of the motor grader 100 to change an angle (e.g., relative to the operator cab 122) and/or a tilt (e.g., relative to the ground) of the moldboard 134. For example, a coupling mechanism (e.g., a push pole or the actuator 148) may enable a coupling between the rear strut 150 of the motor grader 100 and the moldboard 134. The coupling mechanism may include a shear pin to enable mechanical disengagement of the coupling between the rear strut 150 (e.g., to provide relief to components when forces on the coupling become too large). However, such couplings require manual adjustment (e.g., such as when the shear pin breaks) and are mechanically complex.

In other words, to perform the various movement operations (e.g., lifting operations and/or rotational operations), the moldboard 134 may be coupled to both a front end and a rear end of the motor grader 100. Such configurations may result in a dependency between the various movement operations. For example, changing a bench height of the moldboard 134 may result in a tilt angle (e.g., relative to the ground) of the moldboard 134 changing. As a result, a positional control of the moldboard may be complex and imprecise due to the dependency between the various movement operations.

Some implementations described herein enable snow wing assembly 132 having independent rotational control mechanisms. For example, the lift assembly 200 of the snow wing assembly 132 may include the first rotational mechanism 220 and the second rotational mechanism 226. The first rotational mechanism 220 and the second rotational mechanism 226 may be configured to enable independent lifting (e.g., along the bench height 156), angling (e.g., in the first rotational direction 164), and tilting (e.g., in the second rotational direction 166) of the moldboard 134. Additionally, the first rotational mechanism 220 and the second rotational mechanism 226 may be configured to enable connections between the moldboard 134 and a rear strut 150 of the motor grader 100 to be eliminated, thereby improving operator access to the operator cab 122 and improving visibility from within the operation cab 122.

For example, because the first rotational mechanism 220 is coupled to the hinge 206, rather than to the moldboard 134, a rotation of the moldboard 134 in the second rotation direction 166 will not impact or change a rotational position of the moldboard 134 relative to the first rotational direction 164. Additionally, because the second rotational mechanism 226 is coupled to the hinge 206, rather than to the lifting mechanism or the undercarriage assembly 118 (e.g., to a strut, such as the rear strut 150), a rotation of the moldboard 134 in the first rotation direction 164 will not impact or change a rotational position of the moldboard 134 relative to the second rotational direction 166. Additionally, the connection point between the first rotational mechanism 220 and the lifting mechanism may not be to a fixed component (e.g., a mechanically fixed or immovable component). For example, the second vertical member 212 may be a moveable component (e.g., the second vertical member 212 may move with respect to the bench height 156 as the lift assembly 200 raises and lowers the moldboard 134). Therefore, the movement and/or rotation of the moldboard 134 may be independent in at least three directions (e.g., along the bench height 156, in first rotational direction 164, and in second rotational direction 166).

Additionally, the roller bearing 232 may enable the snow wing assembly 132 and/or the lift assembly 200 to support greater axial load at the coupling assembly 140 between the moldboard 134 and the lift assembly 132 (e.g., by using the plurality of fasteners 234 and fasteners 238, rather than a single pin or a single bolt). For example, to facilitate the coupling of the snow wing (e.g., the moldboard 134 of the snow wing) to the lift assembly 200, a coupling assembly may be used. The coupling assembly may typically include a pin or bolt that is passed through the moldboard and the hinge to rotatably couple the moldboard with the hinge (e.g., via a nut, such as a castle nut). However, such hinges and/or coupling assemblies do not provide any means for providing grease or lubricant to interfaces associated with the coupling assembly. Over time, the coupling assembly and/or pin may become susceptible to seizure within the components (e.g., the moldboard 134 and/or the hinge 206) via which they contact (e.g., due to the harshness of conditions in which the motor grader 100 operates). Moreover, because there are multiple interfaces between moving components of the coupling assembly, a likelihood of seizure of a component may be increased. The roller bearing 232 described herein enables a rotation of the moldboard 134 relative to the lift assembly 200 (e.g., and the hinge 206) in the second rotational direction 166. Moreover, because the roller bearing 232 may be internally greased or lubricated, the roller bearing 232 may reduce a likelihood that one or more of the parts of the coupling assembly 140 will seize due to the rotational movement of the parts. Additionally, the plurality of fasteners 234 and fasteners 238 may increase an axial strength of the coupling assembly 140.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). As used herein, satisfying a threshold may, depending on the context, refer to a value being greater than the threshold, greater than or equal to the threshold, less than the threshold, less than or equal to the threshold, equal to the threshold, not equal to the threshold, or the like.

Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A lift assembly for a moldboard of a snow wing assembly of a machine, comprising:

a lifting mechanism, coupled to an undercarriage assembly of the machine, configured to lift the moldboard of the snow wing assembly to a bench height associated with the moldboard;

a hinge rotatably mounted on a bar of the lifting mechanism, wherein the bar defines a first axis, and wherein the hinge is rotatably coupled to the moldboard about a second axis;

a first rotational mechanism, coupled to the lifting mechanism and the hinge, configured to rotate the hinge and the moldboard about the first axis;

a second rotational mechanism, coupled to the hinge and the moldboard, configured to rotate the moldboard about the second axis; and a roller bearing, disposed at an interface between the moldboard and the hinge, configured to enable the moldboard to rotate with respect to the hinge about the second axis, wherein the roller bearing includes a first ring and a second ring, wherein the moldboard is coupled to the first ring via a first plurality of fasteners passing from a side of the moldboard through the roller bearing, and wherein the lifting assembly is coupled to the second ring via a second plurality of fasteners.

2. The lift assembly of claim 1, wherein the first axis is perpendicular to the second axis.

3. The lift assembly of claim 1, wherein the lifting mechanism includes a four-bar linkage having a first vertical member coupled to the undercarriage assembly, a second vertical member, a first horizontal member, and a second horizontal member, and wherein the first rotational mechanism is coupled to the second vertical member of the lifting mechanism.

4. The lift assembly of claim 1, wherein the first rotational mechanism includes a hydraulic cylinder associated with a pressure relief valve that is configured to relieve a pressure associated with the hydraulic cylinder based on the pressure associated with the hydraulic cylinder satisfying a pressure threshold.

5. The lift assembly of claim 1, wherein the first rotational mechanism is configured to cause the moldboard to rotate in a first rotational direction, and wherein the second rotational mechanism is configured to rotate the moldboard in a second rotational direction.

6. The lift assembly of claim 1, wherein the hinge and the second rotational mechanism are coupled to the moldboard proximate to an inboard end of the moldboard.

7. The lift assembly of claim 1, wherein the first rotational mechanism includes a first hydraulic cylinder coupled to a member of the lifting mechanism and the hinge, and wherein the second rotational mechanism includes a second hydraulic cylinder coupled to the hinge and the moldboard.

8. A motor grader, comprising:

a snow wing assembly including a moldboard rotatably coupled to a hinge about a first axis; and a lifting assembly for lifting the moldboard to a bench height, wherein the lifting assembly is coupled to an undercarriage assembly of the motor grader at a side of the motor grader, and wherein the lifting assembly includes the hinge rotatably coupled to a member of the lifting assembly about a second axis;

a first rotational mechanism configured to rotate the moldboard about the first axis, wherein the first rotational mechanism includes a first hydraulic cylinder coupled to the hinge and the moldboard; and a second rotational mechanism configured to rotate the moldboard and the hinge about the second axis, wherein the second rotational mechanism includes a second hydraulic cylinder coupled to the lifting assembly and the hinge; and a roller bearing, disposed at an interface between the moldboard and the hinge, configured to enable the moldboard to rotate with respect to the hinge about the second axis, wherein the roller bearing includes a first ring and a second ring, wherein the moldboard is coupled to the first ring via a first plurality of fasteners passing from a side of the moldboard through the roller bearing, and wherein the lifting assembly is coupled to the second ring via a second plurality of fasteners.

9. The motor grader of claim 8, wherein a lifting operation of the moldboard via the lifting assembly, a tilting operation of the moldboard via the first rotational mechanism, and an angling operation of the moldboard via the second rotational mechanism are configured to move the moldboard independently respective to one another based on the first hydraulic cylinder being coupled to the hinge and the moldboard and based on the second hydraulic cylinder being coupled to the lifting assembly and the hinge.

10. The motor grader of claim 8, wherein the second hydraulic cylinder is coupled to the member of the lifting assembly and the hinge.

11. The motor grader of claim 8, wherein the lifting assembly includes:

a first lifting mechanism coupled to the undercarriage assembly, wherein the first lifting mechanism is configured to lift the moldboard a first portion of the bench height; and a second lifting mechanism mechanically coupled to the first lifting mechanism and the hinge, wherein the second lifting mechanism is configured to lift the moldboard a second portion of the bench height.

12. The motor grader of claim 8, wherein a hydraulic cylinder, of the first hydraulic cylinder or the second hydraulic cylinder, includes a pressure relief valve configured to relieve a pressure associated with the hydraulic cylinder based on the pressure associated with the hydraulic cylinder satisfying a pressure threshold, and wherein relieving the pressure enables the moldboard to rotate from an operator indicated position.

13. The motor grader of claim 12, wherein the hydraulic cylinder, of the first hydraulic cylinder or the second hydraulic cylinder, is configured to return the moldboard to the operator indicated position via a hydraulic operation.

14. The motor grader of claim 8, wherein the first rotational mechanism is configured to cause the moldboard to rotate in a first rotational direction, and wherein the second rotational mechanism is configured to rotate the moldboard in a second rotational direction.

15. A snow wing assembly, comprising:

a moldboard having a first side and a second side, wherein the second side opposes the first side;

a lifting assembly rotatably coupled to the moldboard and configured to lift the moldboard to a bench height; and a roller bearing, disposed at a location of the second side of the moldboard, configured at an interface between the lifting assembly and the moldboard to enable the moldboard to rotate with respect to the lifting assembly about a first axis, wherein the first side of the moldboard includes a recess extending to the location of the second side of the moldboard.

16. The snow wing assembly of claim 15, wherein the lifting assembly is coupled to the roller bearing via a hinge that is rotatably coupled to the lifting assembly and is configured to rotate relative to the lifting assembly about a second axis.

17. The snow wing assembly of claim 16, further comprising:

a first rotational mechanism configured to rotate the moldboard about the first axis, wherein the first rotational mechanism includes a first hydraulic cylinder coupled to the hinge and the moldboard; and a second rotational mechanism configured to rotate the moldboard and the hinge about the second axis, wherein the second rotational mechanism includes a second hydraulic cylinder coupled to the lifting assembly and the hinge.

18. The snow wing assembly of claim 15, wherein the roller bearing includes at least one of:

a slew bearing, a cylindrical roller bearing, a cross roller bearing, a needle bearing, or a tapered roller bearing.

19. The snow wing assembly of claim 15, wherein the roller bearing is disposed at the second side of the moldboard, wherein the roller bearing includes a first ring and a second ring, wherein the moldboard is coupled to the first ring via a first plurality of fasteners passing from the first side of the moldboard through the roller bearing, and wherein the lifting assembly is coupled to the second ring via a second plurality of fasteners.

* * * * *